United States Patent [19]

Cordani

[11] 3,995,564

[45] Dec. 7, 1976

[54] LOW LEVEL FLAT CAR

[75] Inventor: Eugene J. Cordani, Florissant, Mo.

[73] Assignee: ACF Industries, Incorporated, New York, N.Y.

[22] Filed: May 29, 1975

[21] Appl. No.: 581,839

[52] U.S. Cl. ..... 105/418; 105/396

[51] Int. Cl.[2] ..... B61F 1/00

[58] Field of Search ..... 105/418, 419, 413, 404, 105/414, 415, 416, 417, 368 R, 368 B, 396; 52/729, 730

[56] References Cited

UNITED STATES PATENTS

| | | | |
|---|---|---|---|
| 784,665 | 3/1905 | Dodds | 105/419 |
| 1,946,049 | 2/1934 | Weiskopf et al. | 52/729 |
| 3,427,773 | 2/1969 | Kandall | 52/730 X |
| 3,540,384 | 11/1970 | Charles | 105/418 |
| 3,659,724 | 5/1972 | Miller et al. | 105/418 X |

*Primary Examiner*—Robert J. Spar
*Assistant Examiner*—Randolph A. Reese
*Attorney, Agent, or Firm*—Henry W. Cummings

[57] ABSTRACT

A railway flat car is provided including a center sill extending throughout the length of the car. A deck is attached to the center sill, and a side sill assembly is connected at opposite sides of the car to the deck. The side sill assembly includes an upper side sill member adjacent the deck and a depending vertically inclined first plate attached to the upper side sill member. The first plate is attached to crossbearers in the car in the main body of the car and at opposite end portions of the car. The first plate is foreshortened at least in the bolster-truck area of the car. The side sill assembly further includes on either side of the bolster-truck area of the car and through the bolster-truck area of the car, a second vertical plate transversely spaced from the first plate. At least one and preferably a pair of caps are attached to the lower portion of the second plate, preferably on opposite sides of the second plate. Because of the caps the neutral axis of the side sill assembly is located downwardly from the upper side sill member. The caps have a combined cross section sufficient to carry a significant portion of the longitudinal and vertical loads applied to the car in the bolster-truck area. Lower cover plates may be attached to the caps and the second plate and triangular end plates applied transversely to the first plate, second plate and the end of the caps. A significant portion of the longitudinal and vertical loads are transferred from the center sill outwardly to the side sill assemblies by crossbearers on one side of the bolster-truck area and are transferred back to the center sill on the other side of the bolster-truck area.

20 Claims, 11 Drawing Figures

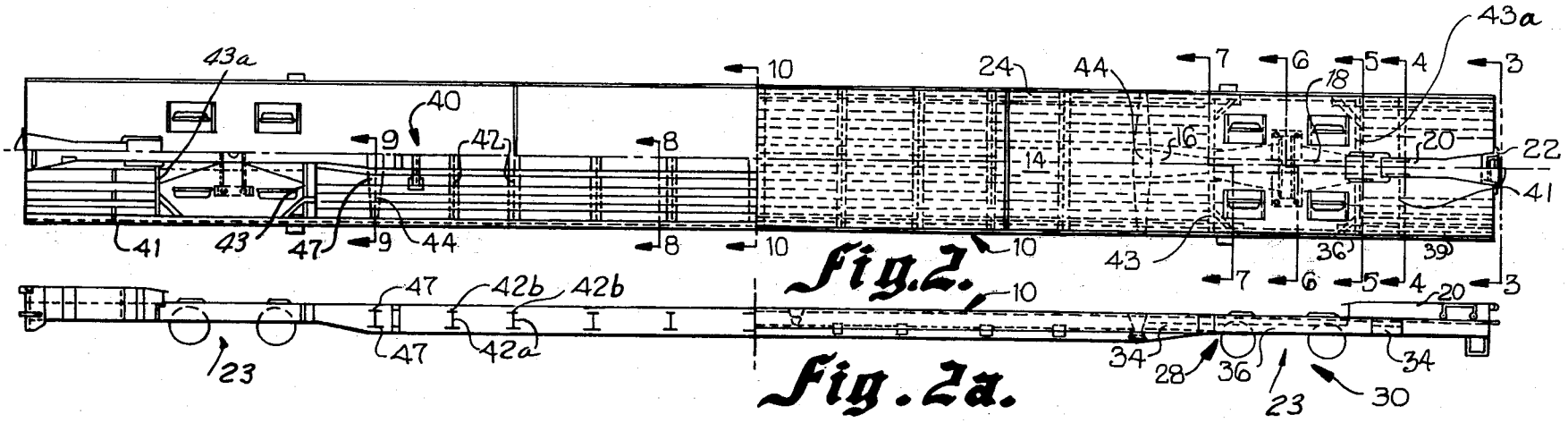
Fig. 2.
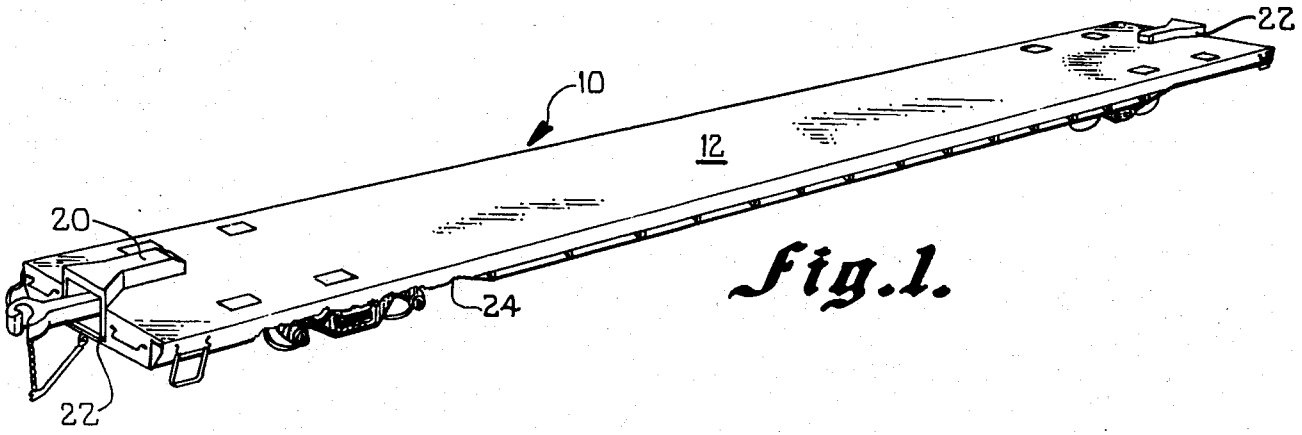
Fig. 2a.
Fig. 1.

LOW LEVEL FLAT CAR

BACKGROUND OF THE INVENTION

The width of the deck in flat cars is dictated by AAR clearance restrictions at the center of the car. In the car bolster-truck area, the truck side rotation about the center plate limits the vertical component of the side sill below the deck. Thus, at opposite ends of the car the movement of the truck side frames requires removal of the lower side sill flange and a portion of the inclined web. In this regard note FIG. 2A of the present application.

In the area of the car bolster-truck area there are beam longitudinal loads resulting, for example, from impacts on the coupler. There are also local loads including vertical loads and fixity moments resulting from the lading and/or autoracks or other lading mounting on the car.

Since the center sill is shallow in low level flat cars being in the area of 8 to 9 inches as compared to 13 inches or higher in other designs, it is necessary to transfer some of the beam loads and local loads out to the side sill area since the shallow center sill is not able to carry all these loads.

However, as mentioned above, the side sill is foreshortened in this area due to rotation of the truck wheels with respect to the side sill.

In order that the side sill may take the bending stresses effectively, it is desired to increase the moment of inertia of the side sill.

It further is desired to displace the neutral axis of this section downwardly as far as possible.

It also is desired to provide a smooth transition between the car bolster-truck area and the end of the car on the one hand, and the car bolster-truck area and the main body of the flat car on the other hand.

A railway flat car is provided having a center sill extending throughout the length of the car. A deck is attached to the center sill and a side sill assembly is integrally affixed at opposite sides of the car to the deck. The side sill assembly comprises an upper side sill member adjacent the deck, and a depending vertically inclined first plate integrally affixed to the upper side sill member. The first plate is affixed to crossbearers in the main body of the car and at opposite end portions of the car. The first plate is foreshortened at least in the bolster-truck area of the car. The side sill assembly further comprises on either side of the bolster-truck area and extending through the bolster-truck area of the car, a second vertical plate transversely spaced from said first plate at the lower portion of said first plate. The second plate is preferably affixed to said first plate at the upper portion and at the lower portion thereof. At least one and preferably a pair of caps are integrally affixed at the lower portion of said second plate preferably on opposite sides thereof. The caps displace the neutral axis of said side sill assembly downwardly from said upper side sill member. Preferably one of the caps extends longitudinally farther than the other cap. A lower cover plate may be applied which joins said first plate and at least one of the caps. The caps have a cross section sufficient to carry a significant portion of the longitudinal and vertical loads applied to the car in the bolster-truck area. A significant portion of the longitudinal and vertical loads are transferred from the center sill outwardly to said side sill assemblies by crossbearers in the bolster-truck area and back to the center sill by crossbearers on the other side of the bolster-truck area.

THE DRAWINGS

FIG. 1 is a perspective view of the low level flat car of the present invention;

FIG. 2 is a plan view of the railway flat car of the present invention;

FIG. 2A is a side elevational view of the railway flat car of the present invention;

DESCRIPTION OF PREFERRED EMBODIMENTS

Figure 3:
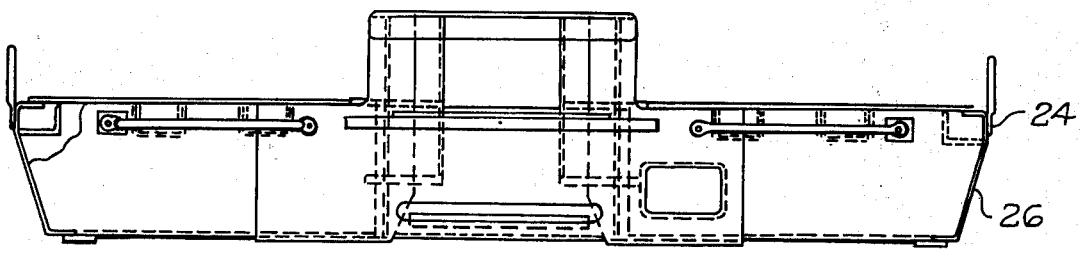
FIG. 3 is an end view of the railway flat car of the present invention.

The low level flat car of the present invention is indicted in the drawings generally at 10. The car comprises a suitable deck 12 having at opposite ends raised coupler portions 20. A center sill 14 extends throughout the length of the car having converging portions 16 leaning to a center plate portion 18 of reduced cross-sectional area. The center sill further comprises a draft gear receiving portion 20 which may be flared at 22 for transverse movement of the coupler.

The flat car further comprises a side sill assembly 25 including an upper side sill member 24 which as illustrated may comprise a box section or other suitable sections such as an angle or a channel. The side sill 24 further comprises a first inclined plate 26.

However, as mentioned above the first plate 26 must be cut out in the area of the truck so that the truck in turning with respect to the car body will have room to negotiate curves in the track. Thus, the vertical extent of the side sill is reduced as indicated at 28 in FIG. 2.

As was also mentioned above, the center plate portion of the center sill is of reduced cross section and is also of reduced vertical extent in the low level flat car usually not more than about 9 inches as compared with 13 inches or higher on standard level flat cars. Thus, the center sill is not of sufficient size to carry the beam load and vertical loads and fixity moments applied to the car in this area. Thus, some of these loads must be transferred to the side sill portion of the car.

Figure 4:
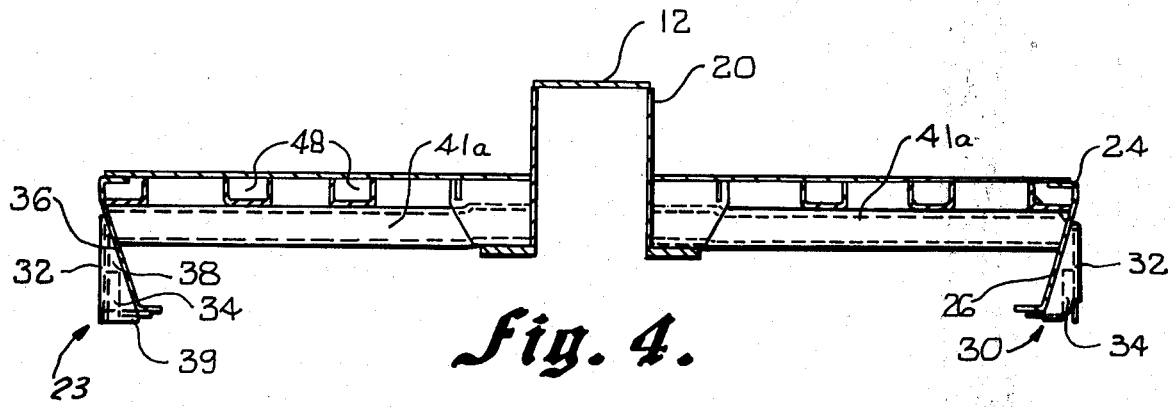
FIG. 4 is a sectional view along the lines 4—4 in FIG. 2.

In accordance with the present invention the side sill assembly 23 further includes a sandwich structure is utilized as part of the side sill in the car bolster-truck area of the car. This sandwich structure is indicated in the drawings generally at 30. As shown in FIG. 4, this sandwich structure may comprise a generally vertical second plate 32 integrally affixed to the upper portion of first plate 26 and having at least one cap or plate 34 integrally affixed to plate 32 in the lower portion thereof. The cross-sectional area of the plate or cap 34 should be sufficient to carry a significant portion of the longitudinal beam loads applied to the car at the end and in the truck portion thereof. It further is preferred that the cap 34 be located at the lower portion of the plate 32 to displace the neutral axis of the section downwardly to as great an extent as possible and feasible.

Figure 5:
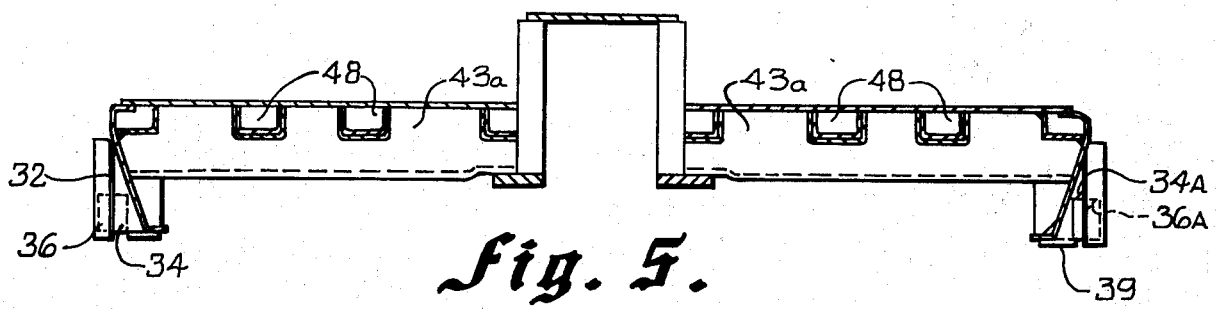
FIG. 5 is a sectional view along the lines 5—5 in FIG. 2.
Figure 6:
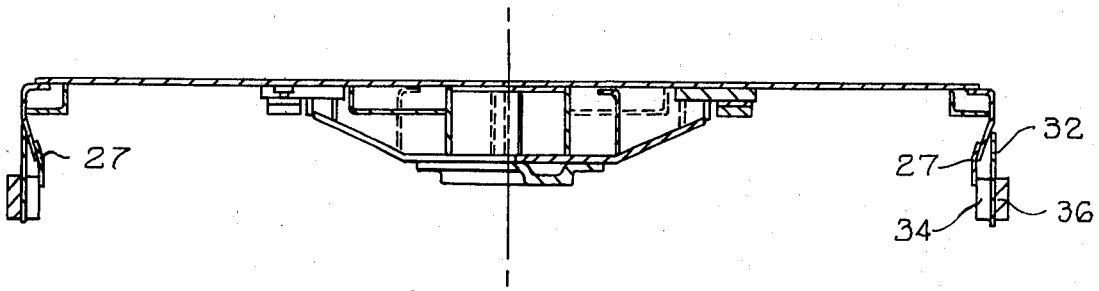
FIG. 6 is a sectional view along the lines 6—6 in FIG. 2.
Figure 7:
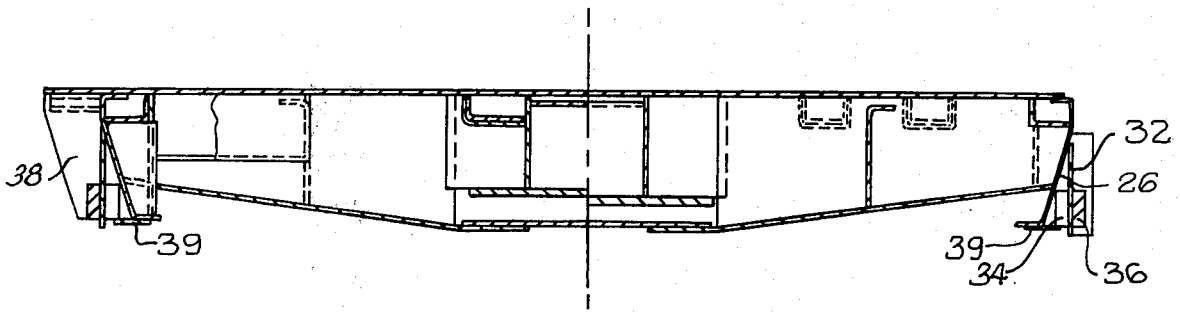
FIG. 7 is a sectional view along the lines 7—7 in FIG. 2.
Figure 8:
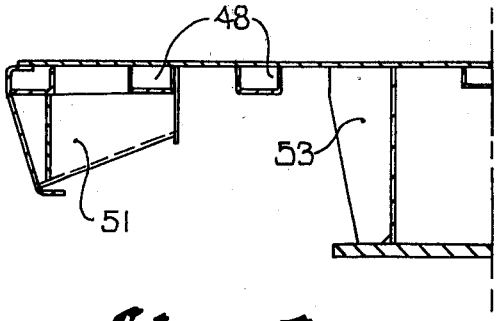
FIG. 8 is a sectional view along the lines 8—8 in FIG. 2.
Figure 9:
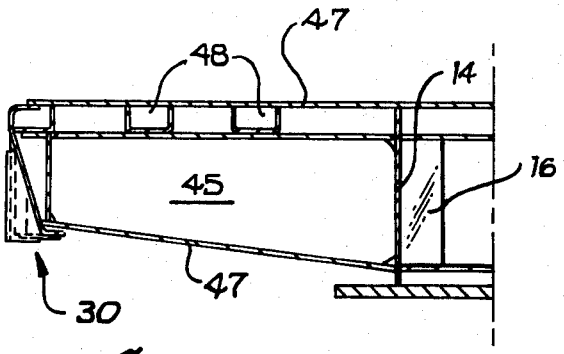
FIG. 9 is a sectional view along the lines 9—9 in FIG. 2.
Figure 10:
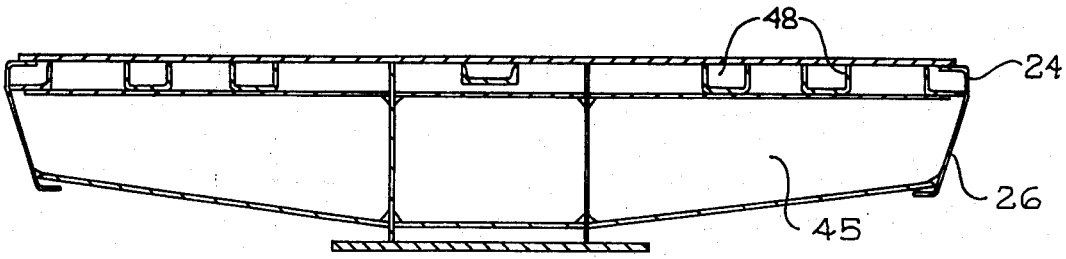
FIG. 10 is a sectional view along the lines 10—10 in FIG. 2.

While a single cap may be utilized as illustrated in FIG. 4, it is preferred to utilize a second cap 36 as illustrated in FIGS. 5 through 7 of the drawings. This construction has the advantage that the stress concentration at the attachment points of the caps to the vertical plate 32 is less since separate fixation points, for example, welds, are utilized as indicated at 34A and 36A in FIG. 5.

The main body of the car comprises suitable transverse structural cross bearers indicated generally at 40. These may comprise, for example, I-beam members 42. Special cross bearers 41, 43, 43*a* and 44 are provided at selected points along the car, for example, to assist in the transfer of the load to and from the side sill assembly. I-beam cross bearers 42 comprise suitable web portions 42*a* and flange portions 42*b*. Cross bearers 41 and 43 may comprise, for example, respectively channels 41*a* (FIG. 4) and pressed angles 43*a* (FIG. 5). Cross bearers 44 have larger I-flange sections 47 which may increase toward the center sill as illustrated in FIG. 2.

As shown in the sectional views, longitudinal stringers 48 may be provided and suitable gussets 51 and 53 provided to insure structural integrity.

In order to provide a generally smooth transfer of the loads between the end portion of the center sill outwardly to the side sill and back into the center sill it is preferred that one or the other of the caps 34 or 36 extend longitudinally on opposite sides of the car bolster-truck area. Thus, as illustrated in FIG. 2, one cap 36 terminates in the area adjacent cross bearers 43 and 43*a*. However, as illustrated by the dotted lines in FIG. 2, inner cap 34 extends longitudinally on the inside of the car up until the portion where cross bearers 41 and 44 are applied. In order to further facilitate the gradual transfer of stresses out to the side sill and back into the outer sill, it is preferred to apply triangular plate 38 as illustrated in FIG. 4 which are integrally affixed to vertical 32 and inclined plate 26. Furthermore, it is preferred to apply lower plates 39 below the caps as illustrated in FIGS. 4, 5 and 7 to the side sill assembly except in the center plate area which as can be seen in FIG. 6 does not utilize such a plate because of the truck clearance requirement. Note also in FIG. 6 that side sill web 26 is cut off and a smaller web 27 applied which provides the necessary clearance for the wheels.

A significant portion of the bending stresses and vertical stresses applied to the end portion of the car are transferred from the center sill 14 outwardly to the side sill through crossbearers 41 and 43*a* and then into the sandwich construction side sill of the present invention. These stresses are then carried through the bolster-truck area longitudinally inwardly.

A portion of the stresses carried by the side sill assembly through the car bolster-truck area are returned to the center sill by cross bearers 43 and 44. It will be noted in FIG. 2 at 16 that the cross section of the center sill also increases at this point so that a higher portion of the load is carried by the center sill in the main body of the car. A similar transfer of stresses occurs at the outer end of the car.

The main body of the car comprises suitable transverse structural cross bearers indicated generally at 40. These may comprise, for example, I-beam members 42. Special cross bearers 41, 43 and 44 may be provided at selected points along the car, for example, to assist in the transfer of the load to and from the side sill assembly. I-beam cross bearers 42 comprise suitable flange portions 45 and web portions 45*a*. Cross bearers 41 and 43 may comprise, for example, respectively channels 41*a* (FIG. 4) and pressed angles 43*a* (FIG. 5). Cross bearers 44 have larger I-flange sections 47 which may increase toward the center sill as illustrated in FIG. 2.

As shown in the sectional views, longitudinal stringers 48 may be provided and suitable gussets 51 and 53 provided to insure structural integrity.

The flat car of the present invention may be provided with fixtures for anchoring autoracks, or fixtures for anchoring hitches for the transport of piggyback trailers or other desired fixtures for affixing a wide variety of ladings for transport on the flat car. The present invention is not to be construed as limited to the particular ladings or fixtures applied to the car or lading transport.

By way of example in prior flat cars it is believed that 7 to 8 percent of the load was usually carried by each of the side sills and the balance of 84 to 86 percent of the load carried by the center sill.

In the flat car of the present invention in the body bolster-truck area of the car each side sill assembly may carry of the order of 15 to 35 percent of the load with the balance carried by the center sill. In the main body of the car the side sills may carry 7 to 10 percent of the load and the balance carried by the center sill. The foregoing fixtures are given by way of example and are not intended to in any way limit the use of the flat car construction of the present invention.

What is claimed is:

1. A railway flat car comprising:

a center sill extending throughout the length of the car; a deck attached to said center sill; a side sill assembly integrally affixed at opposite sides of the car to the deck; said side sill assembly comprising an upper side sill member adjacent said deck; a depending generally vertical first plate integrally affixed to said upper side sill member; said first plate integrally affixed to cross bearers in the car in the main body of the car and at opposite end portions of the car; said first plate being foreshortened at least in the bolster-truck area of the car; said side sill assembly further comprising on either side of the bolster-truck area and extending through the bolster-truck area of the car, a second vertical plate transversely spaced from said first plate; at least one cap member integrally affixed to the lower portion of said second plate, whereby the neutral axis of said side sill assembly is located downwardly from said upper side sill member; said cap having a cross section sufficient to carry a significant portion of the longitudinal loads applied to said car through the bolster-truck area; and whereby a significant portion of the longitudinal and vertical loads are transferred from the center sill outwardly to said side sill assemblies on one side of the bolster-truck area and back to the center sill on the other side of the bolster-truck area.

2. A railway flat car according to claim 1 wherein said generally vertical side sill member is inclined inwardly toward the center line of the car.

3. A railway flat car according to claim 2 wherein a lower cover plate is applied between said first plate and said second vertical plate.

4. A railway flat car according to claim 1 wherein a second cap member is applied to said second vertical plate.

5. A railway flat car according to claim 4 wherein one of said cap members extends longitudinally along the car a greater extent than the other of said caps.

6. A railway flat car according to claim 5 wherein the inner cap member extends a greater extent longitudinally of the car than the outer member.

7. A railway flat car according to claim 4 wherein a lower cover plate is applied between said first plate, said second plate and said caps.

8. A railway flat car according to claim 7 wherein said lower cover plate is removed in at least a position of said bolster-truck area.

9. A railway flat car according to claim 8 wherein said first plate is cut off and a spliced plate applied to the inner cap member in the car bolster-truck area.

10. A railway flat car comprising:

a center sill extending throughout the length of the car; a deck attached to said center sill; a side sill assembly integrally affixed at opposite sides of the car to the deck; said side sill assembly comprising an upper side sill member adjacent said deck; a depending vertically inclined first plate integrally affixed to said upper side sill member; said first plate integrally affixed to cross bearers in the car in the main body of the car and at opposite end portions of the car; said first plate being foreshortened at least in the bolster-truck area of the car; said side sill assembly further comprising on either side of the bolster-truck area of the car and through the bolster-truck area of the car, a second vertical plate transversely spaced from said first plate; a pair of caps integrally affixed to opposite sides of said second plate at the lower portion of said second plate, whereby the neutral axis of said side sill assembly is located downwardly from said upper side sill member; said caps having a combined cross section sufficient to carry a significant portion of the longitudinal and vertical loads applied to said car through the bolster-truck area; and whereby a significant portion of said longitudinal and vertical loads are transferred from the center sill outwardly to said side sill assemblies outside of the bolster-truck area and back to the center sill on the other side of the bolster-truck area.

11. A railway flat car according to claim 10 wherein at least some of said cross bearers transfer the loads into said side sill on one side of the bolster area and other cross bearers return the loads to the car body on the other side of the bolster area.

12. A railway flat car according to claim 11 wherein at least some of said cross bearers comprise I-beams.

13. A railway flat car according to claim 12 wherein at least some of said I-beams have flanges which increase toward the center of the car.

14. A railway flat car according to claim 11 wherein said car further comprises a plurality of longitudinal stringers supporting said deck.

15. A railway flat car according to claim 11 wherein triangular plates join said first plate and said second plate.

16. A railway flat car comprising:

a center sill extending throughout the length of the car; a deck attached to said center sill; a side sill assembly integrally affixed at opposite sides of the car to the deck; said side sill assembly comprising an upper side sill member adjacent said deck; a depending vertically inclined first plate integrally affixed to said upper side sill member; said first plate affixed to cross bearers in the car in the main body of the flat car and at opposite end portions of the car; said first plate being foreshortened at least in the bolster-truck area of the car; said side sill assembly further comprising on either side of the bolster-truck area and extending through the bolster-truck area of the car, a second vertical plate transversely spaced from said first plate at the lower portion of said first plate and affixed to said first plate at the upper portion and at the lower portion of said first plate; a pair of caps integrally affixed to said second plate on opposite sides thereof at the lower portion of said second plate, whereby the neutral axis of said side sill assembly is located downwardly from said upper side sill member; one of said caps extending longitudinally farther than the other cap; a lower cover plate joining said first plate and the inner cap; said caps having a combined cross section sufficient to carry a significant portion of the longitudinal and vertical loads applied to said car through the bolster-truck area; and whereby a sufficient portion of said longitudinal and vertical loads are transferred from the center sill outwardly to said side sill assemblies by cross bearers on one side of the bolster-truck area and back to the center sill by cross bearers on the other side of the bolster-truck area.

17. A railway flat car according to claim 16 wherein the inner cap member extends a greater extent longitudinally of the car than the outer member.

18. A railway flat car according to claim 17 wherein a lower cover plate is applied between said first plate and said second plate.

19. A railway flat car according to claim 18 wherein triangular plates join said first plate and said second plate.

20. A railway flat car according to claim 16 wherein said lower cover plate is removed in at least a portion of said bolster-truck area.

* * * * *

UNITED STATES PATENT OFFICE

CERTIFICATE OF CORRECTION

PATENT NO. : 3,995,564

DATED : Dec. 7, 1976

INVENTOR(S) : Eugene J. Cordani

It is certified that error appears in the above-identified patent and that said Letters Patent are hereby corrected as shown below:

Column 1 between lines 37 and 38 insert -- Summary of the Invention -- .

Column 2, line 58, delete "is".

Signed and Sealed this

Fifteenth Day of March 1977

[SEAL]

*Attest:*

RUTH C. MASON
*Attesting Officer*

C. MARSHALL DANN
*Commissioner of Patents and Trademarks*